US012006695B2

(12) United States Patent
Moon

(10) Patent No.: US 12,006,695 B2
(45) Date of Patent: Jun. 11, 2024

(54) WORK METHOD FOR FINISHING INNER WALL SURFACE OF BUILDING

(71) Applicant: Yun Jung Moon, Jeollabuk-do (KR)

(72) Inventor: Yun Jung Moon, Jeollabuk-do (KR)

( * ) Notice: Subject to any disclaimer, the term of this patent is extended or adjusted under 35 U.S.C. 154(b) by 152 days.

(21) Appl. No.: 17/420,968

(22) PCT Filed: Dec. 24, 2019

(86) PCT No.: PCT/KR2019/018425

§ 371 (c)(1),
(2) Date: Jul. 6, 2021

(87) PCT Pub. No.: WO2020/145553

PCT Pub. Date: Jul. 16, 2020

(65) Prior Publication Data

US 2022/0098871 A1 Mar. 31, 2022

(30) Foreign Application Priority Data

Jan. 7, 2019 (KR) ..... 10-2019-0001635

(51) Int. Cl.
*E04F 13/04* (2006.01)
*E04F 13/00* (2006.01)
*E04G 23/02* (2006.01)

(52) U.S. Cl.
CPC ..... *E04F 13/042* (2013.01); *E04F 13/002* (2013.01); *E04G 23/0214* (2013.01)

(58) Field of Classification Search
CPC ... E04F 13/002; E04F 13/042; E04G 23/0214
See application file for complete search history.

(56) References Cited

U.S. PATENT DOCUMENTS 4,652,331 A * 3/1987 Plasencia ..... E04F 21/1655 156/577
4,707,202 A * 11/1987 Sweeny ..... E04F 21/1655 156/577
4,757,783 A * 7/1988 Matheny ..... E04F 21/026 118/415
4,913,766 A * 4/1990 Lojdstrom ..... B65H 35/0033 156/577
5,079,042 A * 1/1992 Frings ..... E04F 21/00 427/403
5,333,433 A * 8/1994 Porambo ..... E04F 13/042 52/417

(Continued)

FOREIGN PATENT DOCUMENTS

KR 10-2004-0027572 A 4/2004
KR 20-0379252 Y1 3/2005

(Continued)

*Primary Examiner* — James M Ference
(74) *Attorney, Agent, or Firm* — Maschoff Brennan

(57) ABSTRACT

The present invention relates to a work method for finishing an inner wall surface of a building, the method comprising the steps of: a) attaching a finishing tape to at least one of a board joint, a wall surface joint, and a wall surface crack section; b) cutting the finishing tape after attaching same by a predetermined length; c) repeating steps a) and b) for a space to be finished; and d) applying a paint to or wallpapering a building inner wall surface including a surface onto which the finishing tape is attached.

5 Claims, 10 Drawing Sheets

(56) References Cited

U.S. PATENT DOCUMENTS 5,486,394 A * 1/1996 Stough ..... B32B 7/12 428/110
5,687,523 A * 11/1997 Stough ..... E04F 13/042 428/110
5,711,124 A * 1/1998 Stough ..... E04F 13/042 428/354
6,413,606 B1 * 7/2002 Calderon ..... E04F 13/042 428/61
6,565,252 B2 * 5/2003 Dillinger ..... E04F 21/026 366/64
7,325,582 B2 * 2/2008 Smythe ..... E04F 21/1657 156/577
8,257,526 B2 * 9/2012 Thompson ..... E04F 13/042 52/471
8,795,808 B2 * 8/2014 Spanton ..... C09J 7/38 428/109
9,169,426 B2 * 10/2015 Negri ..... C08L 67/08
9,365,455 B2 * 6/2016 Hargrove ..... C08K 5/053
2002/0093876 A1 * 7/2002 Dillinger ..... E04F 21/10 366/64
2004/0211525 A1 * 10/2004 Boutin ..... E04F 21/1655 156/577
2005/0100386 A1 * 5/2005 Murray ..... E04F 21/1655 401/5
2007/0044923 A1 * 3/2007 Jungklaus ..... B65H 35/0053 156/577
2008/0110573 A1 * 5/2008 Verhaar ..... E04F 21/1655 156/506
2008/0139064 A1 * 6/2008 Neill ..... E04F 19/062 156/60
2008/0245026 A1 * 10/2008 Hamilton ..... E04F 13/0891 52/742.16
2009/0044395 A1 * 2/2009 Goldman ..... E04F 21/1655 156/577
2009/0178357 A1 * 7/2009 Francis ..... E04C 2/043 52/309.1
2010/0071292 A1 * 3/2010 Futterman ..... E04F 13/042 52/412
2014/0023833 A1 * 1/2014 Futterman ..... B32B 7/12 428/190
2014/0083035 A1 * 3/2014 Negri ..... C04B 26/16 523/122
2014/0083038 A1 * 3/2014 Negri ..... C04B 26/16 524/375
2015/0007519 A1 * 1/2015 Negri ..... C04B 26/18 52/417
2015/0089893 A1 * 4/2015 Rosenthal ..... E04F 21/1657 156/60
2015/0284543 A1 * 10/2015 Hargrove ..... C04B 26/16 523/122
2017/0138058 A1 * 5/2017 Swartz ..... E04F 13/042
2018/0283015 A1 * 10/2018 Telleria ..... B24B 7/182
2018/0283017 A1 * 10/2018 Telleria ..... E04F 21/12
2022/0098871 A1 * 3/2022 Moon ..... E04F 13/042

FOREIGN PATENT DOCUMENTS

KR 10-44414 B1 7/2010
KR 10-1656688 B1 9/2016
KR 10-2018-0067176 A 6/2018
KR 10-2008406 B1 8/2019

* cited by examiner

WORK METHOD FOR FINISHING INNER WALL SURFACE OF BUILDING

TECHNICAL FIELD

The present invention relates to a method for finishing an inner wall surface of a building, and more specifically, to a method for finishing an inner wall surface of a building using a finishing tape for covering board joints or various cracks on the inner wall surface of the building.

BACKGROUND ART

In some cases, an inner wall surface of a building is finished by applying wallpaper or paint to a concrete wall, but in general, wallpaper or paint is applied onto boards after fixing gypsum boards, CRC (Cellulose Reinforced Cement) boards, MDF, GRC (Glass-fiber Reinforced Cement) boards, wooden boards, and the like to the wall surface by using nails, screws, bolts, anchors, etc.

The above boards are materials having a predetermined standard, and a plurality of boards are fixed to the wall surface or ceiling. Thus, when the boards are fixed to the wall surface or ceiling, a joint is inevitably generated between the boards and it is necessary to take a predetermined measure for the joint in order to apply wallpaper or paint onto the board.

If there is no measure for the joint of the board, painting or wallpaper work may not be smoothly performed. In addition, if the painting or wallpaper work is carried out without any measures required to prevent deformation of the joint, cracks may occur in the joint due to deformation, shrinkage, and relaxation of the board due to changes in temperature and humidity, causing the coating layer to be delaminated and cracked so that the aesthetic appearance may be lowered and users may feel anxiety.

As a conventional method for finishing the joint of the board, a method of using a mesh tape, a method of using a woven fabric such as lawn, a method of using a paper tape, etc. have been used.

In case of using the mesh tape, the mesh tape is attached to the joint of the board, putty work is performed twice, sanding work is done, and then a process of applying paint is performed. However, there are problems in that the process before the painting work is so long that the working time is increased, and the adhesive force and strength of the mesh tape are low, so the board cannot withstand the deformation, causing crack and delamination of the coating layer.

In case of using the lawn, after the putty work with adhesive force is performed or bond is applied onto the joint of the board, the lawn is attached while scrapping the lawn with a spatula, the putty work is performed twice, the sanding work is done, and then a process of applying paint is performed. However, this method also takes a long time before the painting work and the durability is bad.

In case of using the paper tape, the putty work is performed twice on the paper tape, and then the sanding and painting works are performed.

These conventional methods are expensive because the process is too long, cracks often occur due to poor durability, and skilled workers are required for the putty work, so great variation may occur in construction quality depending on the worker.

Korean Registered Utility Model Publication No. 20-0439881 relates to an adhesive tape for processing a gypsum board joint, in which an adhesive layer is formed on a strip-shaped nonwoven substrate and a cover paper for protecting the adhesive layer is laminated, wherein the nonwoven substrate is in the form of a long fiber with a width of 35 to 40 mm and formed of nonwoven fabrics having superior adhesive force, elongation rate, and durability, which are entangled with each other and densely formed, have a wide specific surface area to improve the adhesive strength without being corroded, and can absorb the variation in shrinkage of the gypsum board, in which the adhesive tape for filling the gypsum board joint has the functional structure in that holes formed through the nonwoven fabric and the adhesive layer and having a size of 3 to 7 mm are repeatedly formed in longitudinal and transverse directions at an interval of 8 to 10 mm to fill the putty, and the material and structure are organically combined to absorb complex shrinkage changes among the gypsum board, putty, and non-woven substrate in the non-woven tape itself to increase the adhesive force. However, Korean Registered Utility Model Publication No. 20-0439881 also has the complex working process, so the above problem cannot be solved.

Therefore, it is necessary to develop a finishing tape that can reduce process time for joint finishing work and painting work without generating cracks in a coating layer by firmly supporting a board even if the board is deformed, and a method for finishing an inner wall surface of a building.

DISCLOSURE

Technical Problem

In order to solve the above problems of the related art, an object of the present invention is to provide a finishing tape having excellent durability and capable of performing finishing work and painting work for cracks and joints in a simple way, and a method for finishing an inner wall surface of a building.

Technical Solution

The present invention provides a work method for finishing an inner wall surface of a building, and the work method includes the steps of: a) attaching a finishing tape to at least one of a board joint, a wall surface joint, and a wall surface crack section; b) cutting the finishing tape after attaching the finishing tape by a predetermined length; c) repeating steps a) and b) for a space to be finished; and d) applying a paint or a wallpaper to an inner wall surface of a building including a surface onto which the finishing tape is attached.

When attaching the finishing tape to the board joint in step a), the finishing tape, which is attached at once without being cut, may be attached to 4 to 6 board edges.

The finishing tape may be a finishing tape (100) for painting work, the finishing tape (100) for painting work may include an exterior paper (10), an interior paper (20), and a coating layer (30) formed on a partial surface of the exterior paper (10), exterior paper adhesive layers (41) may be formed on both sides of any one surface of the exterior paper (10) along a longitudinal direction, the coating layer (30) may be formed between the exterior paper adhesive layers (41), an interior paper adhesive layer (40) may be formed over a whole area of any one surface of the interior paper (20), and the other surface of the interior paper (20) may be placed on the coating layer (30) so that the interior paper (20) and the coating layer (30) may be provided in a non-adhesive state.

The finishing tape may be a finishing tape (200) for putty work, the finishing tape (200) for putty work may include an exterior paper (10), an interior paper (20), and a coating layer (30) formed on a partial surface of the exterior paper (10), exterior paper adhesive layers (41) may be formed on both sides of any one surface of the exterior paper (10) along a longitudinal direction, the coating layer (30) may be formed on the other surface, not the one surface on which the exterior paper adhesive layer (41) is formed, an interior paper adhesive layer (40) may be formed over a whole area of any one surface of the interior paper (20), and the other surface of the interior paper (20) may be placed on the exterior paper (10) between the exterior paper adhesive layers (41) so that the exterior paper (10) and the interior paper (20) may be provided in a non-adhesive state.

The exterior paper (10) may have a multi-layer structure including an outer exterior paper (11) and an inner exterior paper (12), the outer exterior paper (11) may have a width smaller than a width of the inner exterior paper (12), or the outer exterior paper (11) may have a width greater than a width of the inner exterior paper (12).

The work method may further include a step of applying a woodworking bond between the exterior paper (10) and the interior paper (20) of a cut section, or combining the exterior paper (10) and the interior paper (20) to each other by using a stapler, after step b).

When performing step c), an intermediate agent may be applied on the finishing tape (200) for putty work that is attached first, and then a next finishing tape (200) for putty work may be attached thereon at an intersection portion (50) where the finishing tape (200) for putty work may intersect.

When performing step c), if the finishing tape is attached to a same location twice, the work method may further include the steps of c-1) attaching a first finishing tape such that the interior paper adhesive layer (40) and the exterior paper adhesive layer (41) are attached to a wall surface; c-2) applying a wallpaper paste or an intermediate agent on the first finishing tape; c-3) attaching a second finishing tape on the applied wallpaper paste or intermediate agent in such a way that one side of the second finishing tape, other than the surface on which the interior paper adhesive layer (40) and the exterior paper adhesive layer (41) are formed, is attached to the wallpaper paste or the intermediate agent; and c-4) removing the interior paper (20) of the second finishing tape.

Alternatively, when performing step c), if the finishing tape is attached to a same location twice, the work method may further include the steps of: c'-1) attaching a first finishing tape such that the interior paper adhesive layer (40) and the exterior paper adhesive layer (41) are attached to a wall surface; c'-2) applying a wallpaper paste or an intermediate agent on the first finishing tape; and c'-3) attaching a second finishing tape on the applied wallpaper paste or intermediate agent in which a finishing tape without an interior paper (20) is used as the second finishing tape, and one side of the second finishing tape, other than the surface on which the exterior paper adhesive layer (41) of the second finishing tape is formed, is attached to the wallpaper paste or the intermediate agent.

Line-putty may be performed around an attachment part of the finishing tape (200) for putty work, or all-putty may be performed over a whole area of a wall surface including the attachment part of the finishing tape (200) for putty work, before step d).

Advantageous Effects

The method for finishing an inner wall surface of a building of the present invention has the following effects.

First, the finishing tape formed with the adhesive layer can be attached directly to the joint of the board, and the painting work can be performed immediately after attaching the finishing tape, so a work that takes total 4 days (tape attachment, pre-putty and primary putty work (1 day), secondary putty work (1 day), sanding work (1 day), and painting work (1 day)) can be completed in one day (tape attachment and painting works).

Second, since the quality of the finishing work can be guaranteed by the finishing tape, work costs and time can be saved, cracks of the finished surface can be prevented, labor costs can be reduced because it does not require skill, and standardized construction can be achieved.

Third, since the outer and interior papers are configured in a multi-layer structure, the resistance to joint deformation is high, the interface between the joint and the finishing tape attached to the joint can be made smooth, and marks of the finishing tape are rarely exposed after the painting work.

※ Brief Description of Reference Numerals

Figure 1:
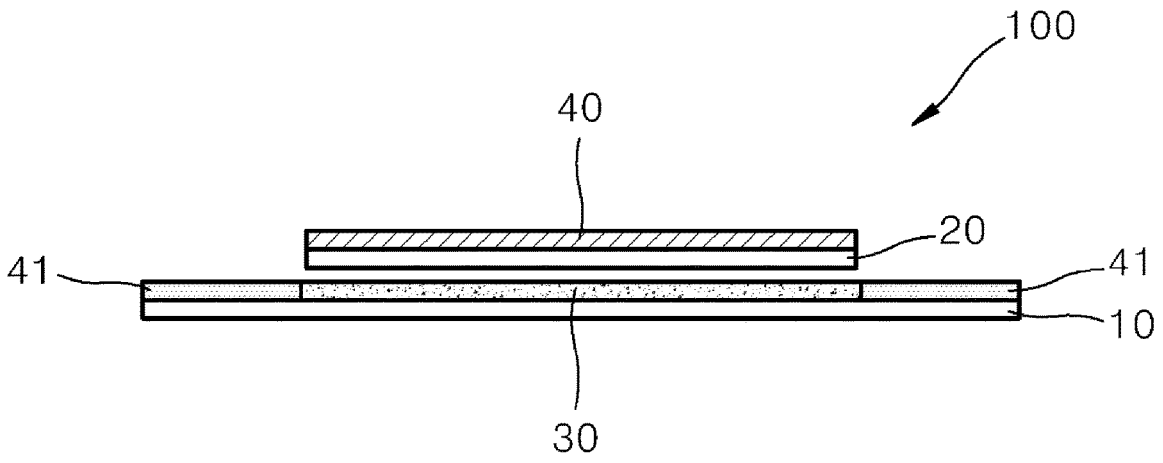
FIG. 1 is a sectional view of a finishing tape for painting work according to the present invention.

| | |
|---|---|
| 100. finishing tape for painting work | 200. finishing tape for putty work |
| 301. board | 302. board joint |
| 10. exterior paper | 20. interior paper |
| 11. outer exterior paper | 12. inner exterior paper |
| 21. outer interior paper | 22. inner interior paper |
| 30. coating layer | |
| 40. interior paper adhesive layer | 41. exterior paper adhesive layer |
| 50. intersection portion | |

BEST MODE

Mode for Invention

Hereinafter, embodiments of the present invention will be described in detail with reference to the accompanying drawings so that those skilled in the art can easily carry out the present invention. However, the present invention may be embodied in various forms and is not limited to the embodiments described herein. In order to clearly explain the present invention, elements that are irrelevant to the description are omitted in the drawings, and similar reference numerals are assigned to similar parts throughout the specification. Throughout the specification, when a part is referred as to "include" a certain component, it means that other components may be further included, rather than excluding other components, unless otherwise stated. Hereinafter, preferred embodiments of the present invention will be described in detail with reference to the accompanying drawings.

First, the finishing tape used in the work method for finishing the inner wall of the building of the present invention will be described, and then the finishing work process will be described in detail.

The finishing tape used in the present invention mainly has two embodiments.

Figure 3:
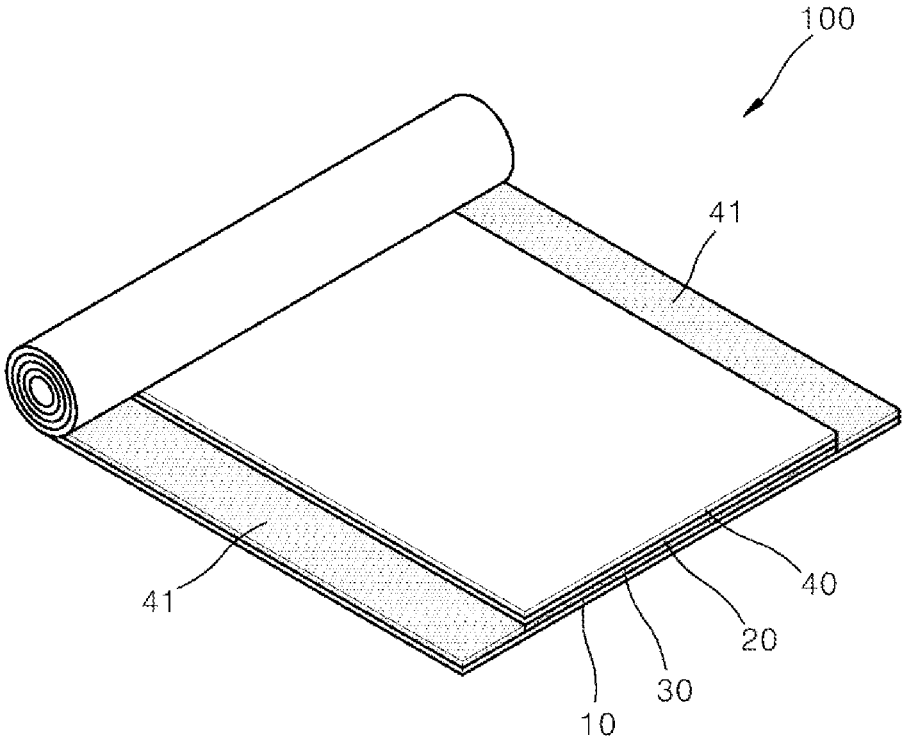
FIG. 3 is a perspective view of a finishing tape for painting work according to the present invention.

FIG. 1 is a sectional view of the finishing tape 100 for painting work. As shown in FIG. 3, when actually used, the finishing tape is in the form of a roll and is attached to the joint by unwinding the roll.

The finishing tape 100 for painting work refers to a finishing tape to which paint can be directly applied without a separate process after attaching the finishing tape.

The finishing tape 100 for painting work may largely include an exterior paper 10 and an interior paper 20, in which exterior paper adhesive layers 41 may be formed on both sides of one surface of the exterior paper 10 (a surface attached to a wall surface or board) along the longitudinal direction and a coating layer 30 may be formed between the exterior paper adhesive layers 41.

The interior paper 20 may be placed on the coating layer 30, and the interior paper adhesive layer 40 may be formed over the whole area of one surface of the interior paper 20 opposite to the other surface of the interior paper 20 in contact with the coating layer 30. Therefore, the interior paper 20 and the coating layer 30 may be manufactured in a state in which they are not bonded to each other.

The width of the interior paper 20 may be configured to be less than or equal to the width of the coating layer 30.

In addition, the width of the interior paper 20 may be configured to be less than or equal to the distance between both exterior paper adhesive layers 41, and the width of the coating layer 30 may be configured to be less than the distance between both exterior paper adhesive layers 41.

The exterior paper 10 and the interior paper 20 may constitute the basic configuration of the finishing tape 100 for painting work, and may have a predetermined width and length. Further, resin-treated base paper may be used for the exterior paper 10 and the interior paper 20. Resin treatment may allow a lining paper to have water-resistance and deformation-resistance properties so that the lining paper can be prevented from being torn or deformed after the finishing work for the joint on the wall surface, may absorb paint by holding moisture according to the temperature difference, and may prevent the wall surface or ceiling covered with the paper from being delaminated.

Figure 5A:
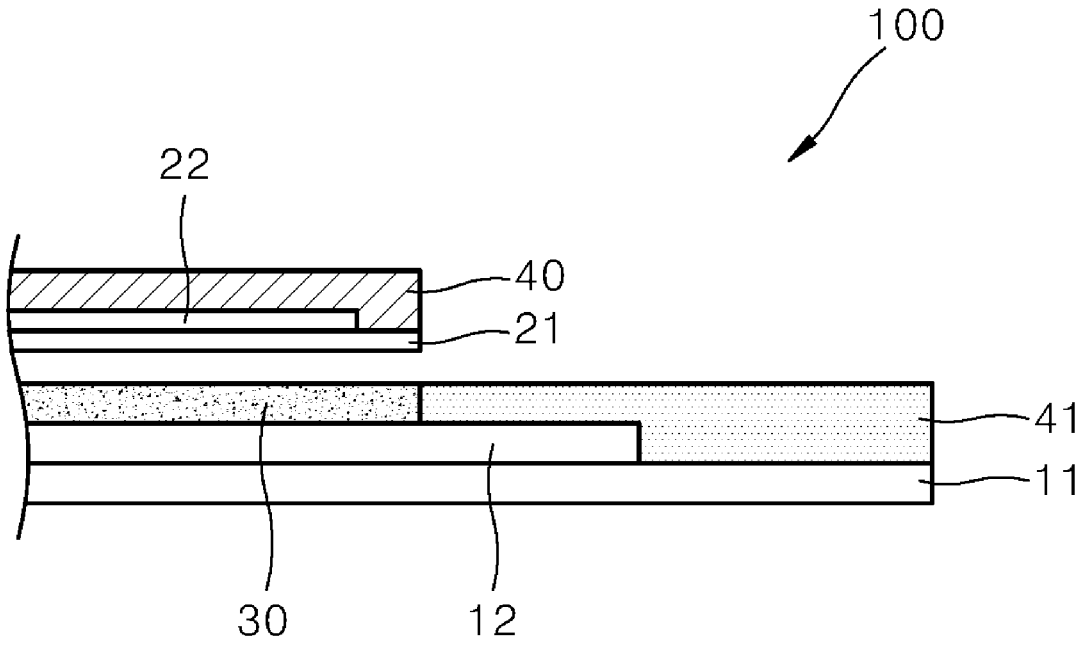
FIG. 5 is a partially enlarged view of a finishing tape for painting work according to the present invention.
Figure 5B:
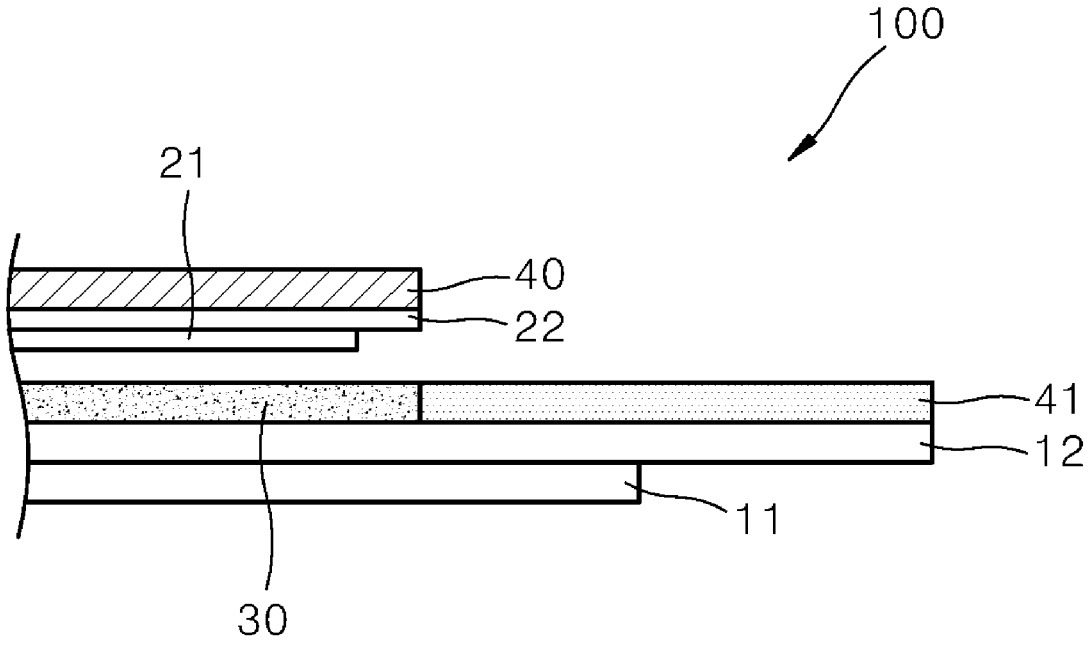

FIG. 5 is an enlarged view of one side of the finishing tape 100 for painting work. As shown in FIG. 5, the exterior paper 10 may include an outer exterior paper 11 and an inner exterior paper 12, in which the outer exterior paper 11 and the inner exterior paper 12 are attached to each other, and the interior paper 20 may include an outer interior paper 21 and an inner interior paper 22, in which the outer interior paper 21 and the inner interior paper 22 are attached to each other. FIG. 5 shows that the exterior paper 10 and the interior paper 20 are configured in a two-layer structure. In some cases, the exterior paper 10 and the interior paper 20 may be configured in a multi-layer structure such as a three-layer structure or a four-layer structure.

As shown in FIG. 5 (*a*), the width of the outer exterior paper 11 located outside the wall surface or board may be made larger than the width of the inner exterior paper 12 located inside the wall surface or board, or, as shown in FIG. 5 (*b*), the width of the outer exterior paper 11 located outside the wall surface or board may be made smaller than the width of the inner exterior paper 12 located inside the wall surface or board to increase the adhesion force and durability of the exterior paper 10 and the interior paper 20, to prevent the step difference at the outside of the finishing tape, and to smoothly finish an edge of the exterior paper when the exterior paper 10 is attached to the wall surface or board.

If the exterior paper has a multi-layer structure of three or more layers, the edge of the finishing tape may be more gently formed.

The width of the outer interior paper 21 may be made larger than the width of the inner interior paper 22 (see FIG. 5 (*a*)), and the width of the outer interior paper 21 may be made smaller than the width of the inner interior paper 22 (see FIG. 5 (*b*)).

The coating layer 30 may be a part having certain flexibility, elasticity, and water repellency, and may increase the tensile strength of the exterior paper, thereby preventing the exterior paper from being deformed by moisture.

In addition, the coating layer 30 may maintain the original shape of the exterior paper 10 to prevent deformation and depression of the exterior paper due to the application of heavy and large particles such as plaster, putty, etc., as well as paint The coating layer 30 may be formed by applying a coating solution onto the exterior paper 10, and the coating solution preferably includes an acrylic resin. The acrylic resin provides the basic mechanical strength to the exterior paper and has excellent weather resistance, so it can prevent the finishing tape from being deformed even when there are changes in humidity and temperature after the finishing work.

The content of the acrylic resin contained in the coating solution is preferably 20 to 60% by weight. When the content of acrylic resin is less than 20% by weight, the effect of preventing deformation against environmental changes is low, and when the content of the acrylic resin exceeds 60% by weight, the effect of preventing deformation is not significantly increased compared to the increase in the content, so it is limited to the above range.

In addition to the acrylic resin, toluene, silicone oil (KF96), and wax may be further included.

The toluene may play a role of evenly dispersing the acrylic resin over the whole surface of the exterior paper and allowing the blended resin to be absorbed into the base paper in an appropriate amount, the silicone oil (KF96) has excellent releasability and water repellency, so it can prevent foreign substances such as wallpaper glue from adhering to the coating layer, and the wax may allow the coated base paper to be dried well and serve as a release agent.

The exterior paper adhesive layer 41 and the interior paper adhesive layer 40 may be formed by applying a wallpaper glue or woodworking bond to the corresponding part.

Figure 2:
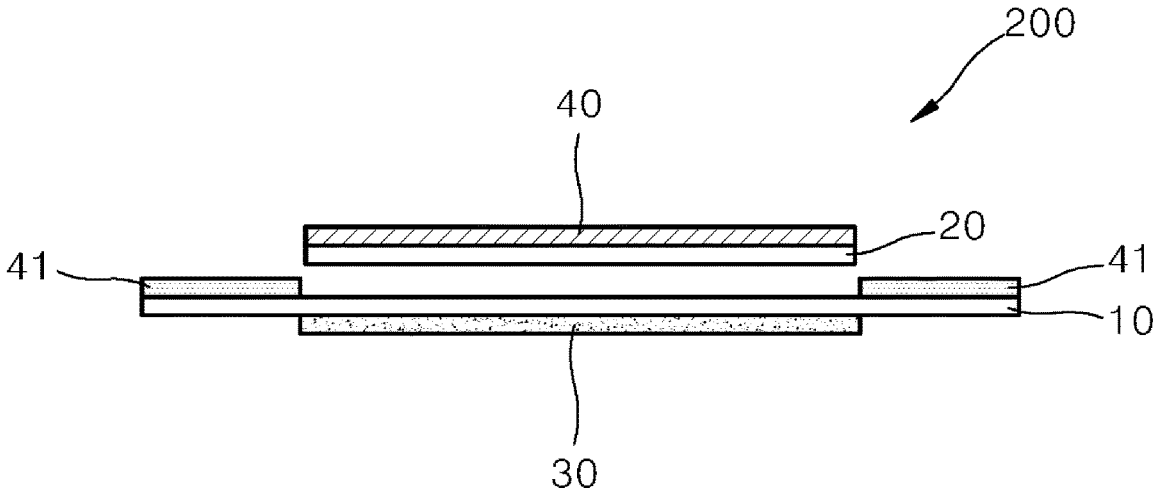
FIG. 2 is a sectional view of a finishing tape for putty work according to the present invention.
Figure 4:
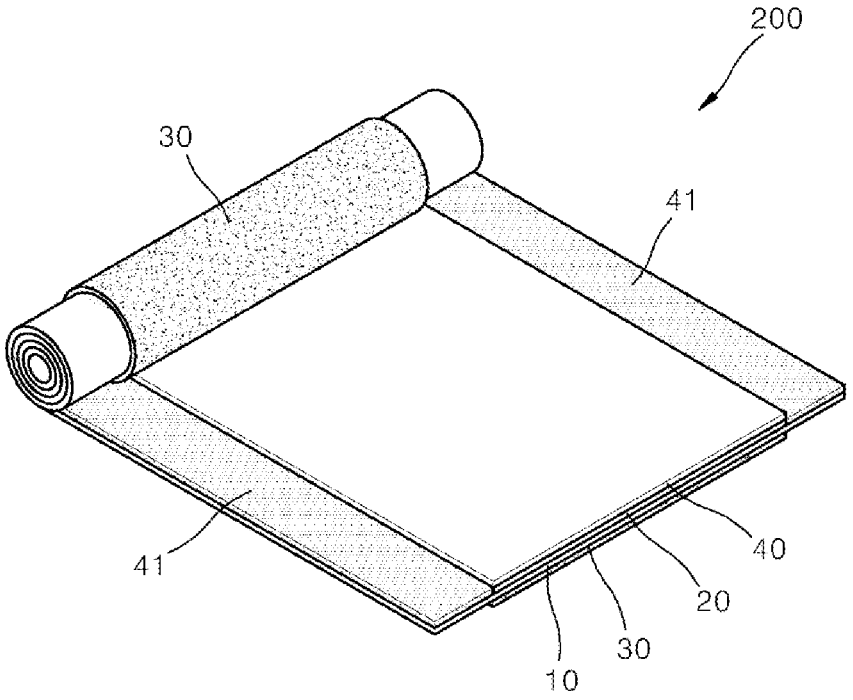
FIG. 4 is a perspective view of a finishing tape for putty work according to the present invention.

FIG. 2 is a sectional view of the finishing tape 200 for putty work. As shown in FIG. 4, when actually used, the finishing tape 200 is in the form of a roll and is attached to the joint by unwinding the roll.

The finishing tape 200 for putty work may be a finishing tape for applying paint after the finishing tape has been attached and the line putty and/or all putty work has been performed.

The finishing tape 200 for putty work may also include an exterior paper 10 and an interior paper 20, similarly to the finishing tape 100 for painting work, and the coating layer 30 may be formed at the opposite side of the interior paper 20 (outside of the wall surface), unlike the finishing tape 100 for painting work.

That is, the exterior paper adhesive layers 41 may be formed on both sides of any one surface (surface attached to a wall surface or board) of the exterior paper 10 along the longitudinal direction, the coating layer 30 may be formed on the other surface, not the one surface where the exterior paper adhesive layer 41 is formed, and the interior paper 20 may be located between the exterior paper adhesive layers 41.

The interior paper 20 may be positioned in a non-adhesive state with the exterior paper 10, and the interior paper adhesive layer 40 may be formed over the whole area of any one surface (a surface attached to a wall surface or board) of the interior paper 20.

The width of the interior paper 20 may be configured to be less than or equal to the distance between both exterior paper adhesive layers 41, and the width of the coating layer 30 may be configured to be less than or equal to the distance between both exterior paper adhesive layers 41.

Figure 6A:
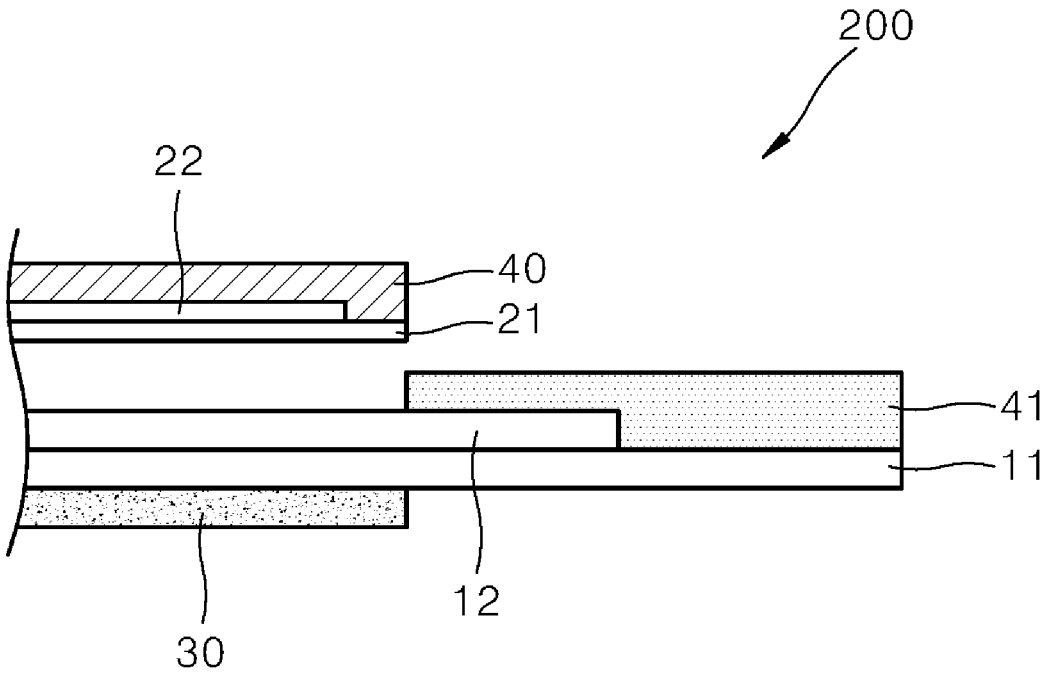
FIG. 6 is a partially enlarged view of a finishing tape for putty work according to the present invention.
Figure 6B:
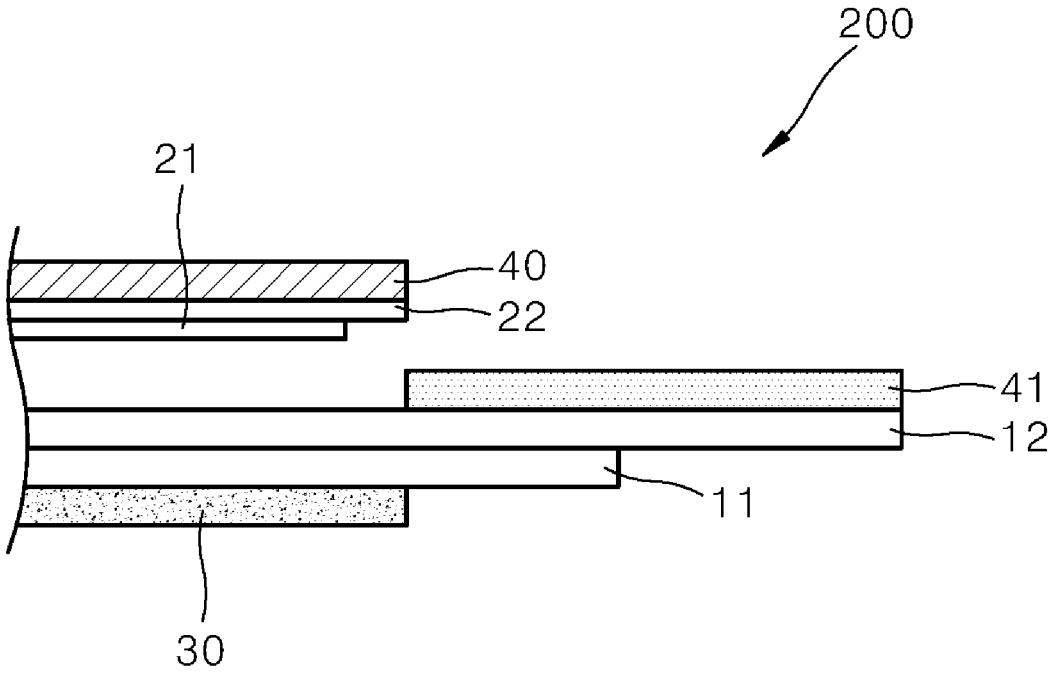

FIG. 6 is an enlarged view of one side of the finishing tape 100 for putty work. As shown in FIG. 6, the exterior paper 10 may include an outer exterior paper 11 and an inner exterior paper 12, in which the outer exterior paper 11 and the inner exterior paper 12 are attached to each other, and the interior paper 20 may include an outer interior paper 21 and an inner interior paper 22, in which the outer interior paper 21 and the inner interior paper 22 are attached to each other. FIG. 6 shows that the exterior paper 10 and the interior paper 20 are configured in a two-layer structure. In some cases, the exterior paper 10 and the interior paper 20 may be configured in a multi-layer structure such as a three-layer structure or a four-layer structure.

As shown in FIG. 6 (*a*), the width of the outer exterior paper 11 located outside the wall surface or board may be made larger than the width of the inner exterior paper 12 located inside the wall surface or board, or, as shown in FIG. 6 (*b*), the width of the outer exterior paper 11 located outside the wall surface or board may be made smaller than the width of the inner exterior paper 12 located inside the wall surface or board to increase the adhesion force and durability of the exterior paper 10 and the interior paper 20, to prevent the step difference at the outside of the finishing tape, and to smoothly finish an edge of the exterior paper when the exterior paper 10 is attached to the wall surface or board.

If the exterior paper has a multi-layer structure of three or more layers, the edge of the finishing tape may be more gently formed.

The width of the outer interior paper 21 may be made larger than the width of the inner interior paper 22 (see FIG. 6 (*a*)), and the width of the outer interior paper 21 may be made smaller than the width of the inner interior paper 22 (see FIG. 6 (*b*)).

In the finishing tape 200 for putty work, the position of the coating layer 30 is different from that of the finishing tape 100 for painting work, but the coating layer having the same composition is used.

However, in the finishing tape 200 for putty work, since the coating layer 30 is formed on the outside of the wall surface or board, the coating layer has higher resistance to moisture due to the hydrophobicity of the coating solution. In this way, when the finishing tape 200 for putty work is installed in a humid indoor room such as a bathroom, it is possible to suppress deformation of the finishing tape due to moisture as much as possible. In addition, it is possible to withstand the heavy weight of the applied putty due to the coating layer, and the coating layer is dried almost the same as the putty that is dried fast, so there is no problem on the surface.

The exterior paper adhesive layer 41 and the interior paper adhesive layer 40 of the finishing tape 200 for putty work may also be formed by applying a wallpaper glue or woodworking bond to the corresponding part.

In both cases of the finishing tape 100 for painting work and the finishing tape 200 for putty work, the width of the exterior paper 10 may be set in the range of 12 to 20 cm, and the width of the interior paper 20 may be set in the range of 3.5 to 15 cm.

Meanwhile, in order to improve the moisture barrier performance and tensile strength of the interior paper 20, a coating layer (not shown) may also be formed on the interior paper 20. The coating layer formed on the interior paper 20 may be placed on a portion in contact with the interior paper adhesive layer 40 between two surfaces of the interior paper 20.

Hereinafter, a method of finishing an inner wall surface of a building using the finishing tapes 100 and 200 described above will be described.

In the present specification, the wall surface may refer to a certain surface formed on an inner wall, a ceiling, and a floor inside the building, and may also include a concrete wall surface and a wall surface formed by fixing various boards. In addition, the step difference formed on the wall surface may refer to a portion where there is a difference in height due to a connection of interior materials (boards) for wall construction or a portion where there is a difference in surface height at a connection part due to concrete construction. In addition, the step difference may be applied to all areas that need finishing work with paints and wallpapers. Further, breakage (crack) may refer to crack occurring on a concrete wall surface, a gap occurring between boards to be constructed, a damaged part, or various types of internal cracks generated by an external force of a building. The term 'crack' may be used for portions where elements are disconnected from each other, and it is not limited to any specific place.

In addition, the board used in this specification may include a gypsum board, a CRC (Cellulose Reinforced Cement) board, MDF, a GRC (Glass-fiber Reinforced Cement) board, a wood board, and the like.

The embodiment described with reference to FIGS. 7 to 12 is intended to describe a wall surface to which a plurality of boards 301 are attached, but the method of finishing the inner wall surface described herein is not limited only to a board joint 302, but it can also be applied to cracks in concrete walls.

Figure 7:
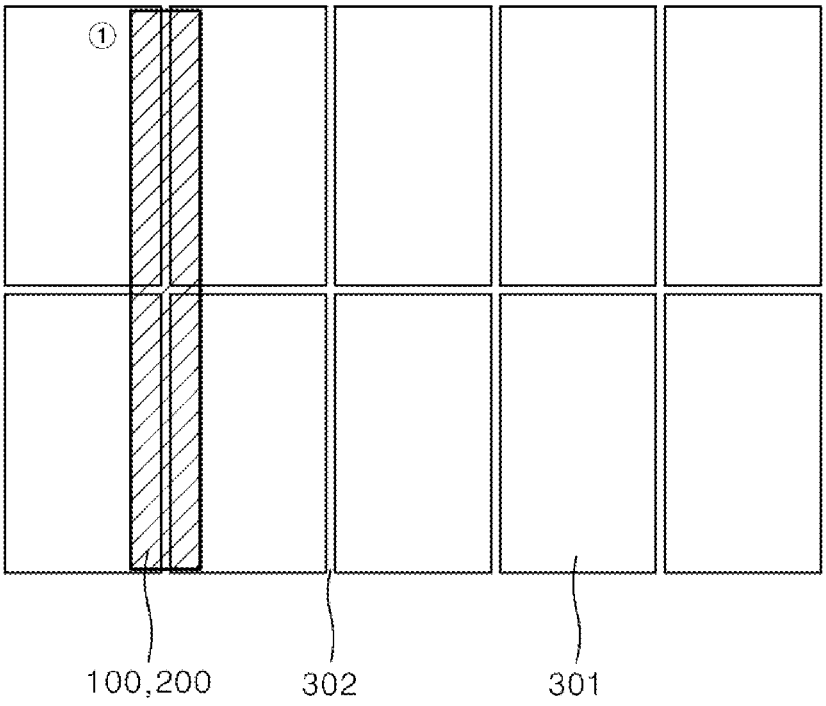
FIGS. 7 to 9 are views for explaining the process of finishing work of the present invention.

Referring to FIG. 7, a plurality of boards 301 are attached to the wall surface, and the process of attaching the finishing tapes 100 and 200 to the board joint 302 generated by the boards will be described.

As shown in FIG. 7, the first finishing tape 100 and 200 is attached and cut. Since the finishing tapes 100 and 200 are provided in the form of a roll, the finishing tapes 100 and 200 are released from the roll and attached in a state in which ends of the finishing tapes 100 and 200 are attached to the wall surface.

The attachment of the finishing tapes 100 and 200 may be performed with respect to two to three boards 301 at a time. FIG. 7 shows the construction in which two boards are connected at a time. With this construction, a total of 4 to 6 board edges are covered at a time by attaching and cutting the finishing tapes 100 and 200.

It is better to construct many boards at a time for workability. However, if the work is carried out to cover more than three boards, there is a risk of cracks after construction, so the number of boards is limited to three or less.

Figure 10:
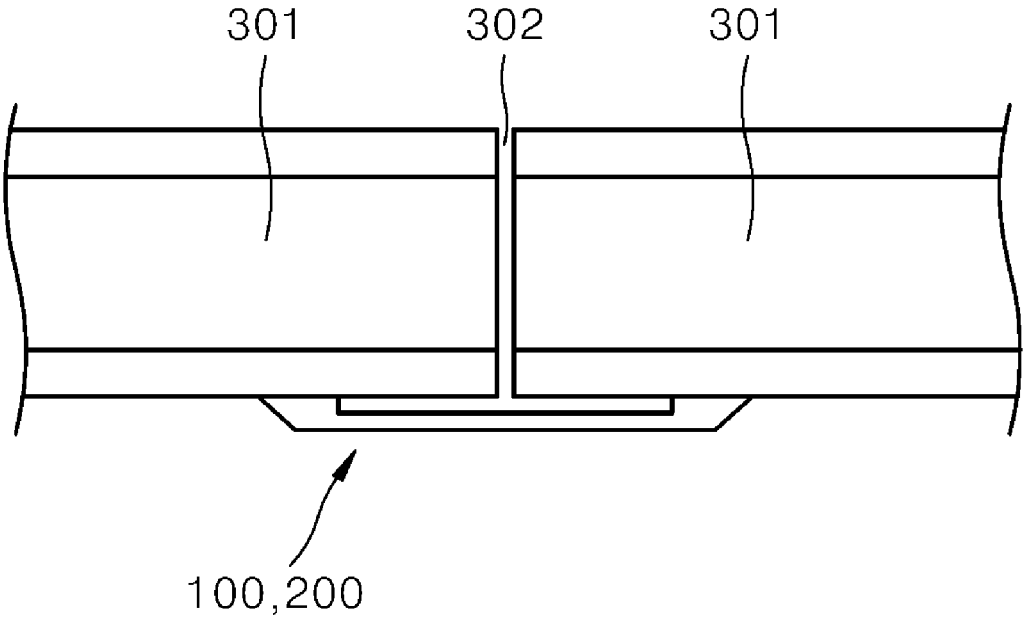
FIGS. 10 and 11 are views showing a finishing tape attached to a board joint of the present invention.
Figure 11:
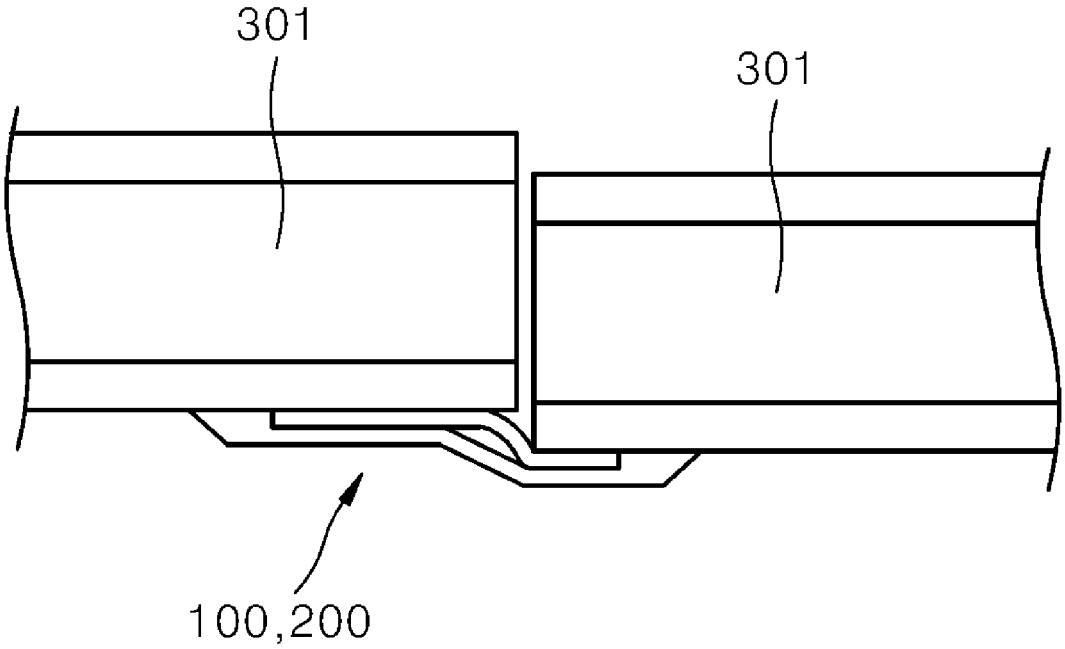

In addition, it is preferable to inwardly cut both ends of the finishing tapes 100 and 200 within 2 mm from an edge line of the board 301, and a woodworking bond is applied between the exterior paper 10 and the interior paper 20 in the vicinity of the ends of the cut finishing tapes 100 and 200, or the exterior paper and the interior paper are attached to each other by using a stapler or tacker. When attaching the finishing tapes 100 and 200, if there is no step difference between the boards 301 as shown in FIG. 10, it is preferred to attach the finishing tapes such that the board joint 302 is located at the center of the finishing tape 100 and 200. When there is a step difference between the boards 301 as shown in FIG. 11, the finishing tape is attached such that the board 301 located at a relatively low position has a wider attachment surface for ensuring more firm attachment.

Figure 12:
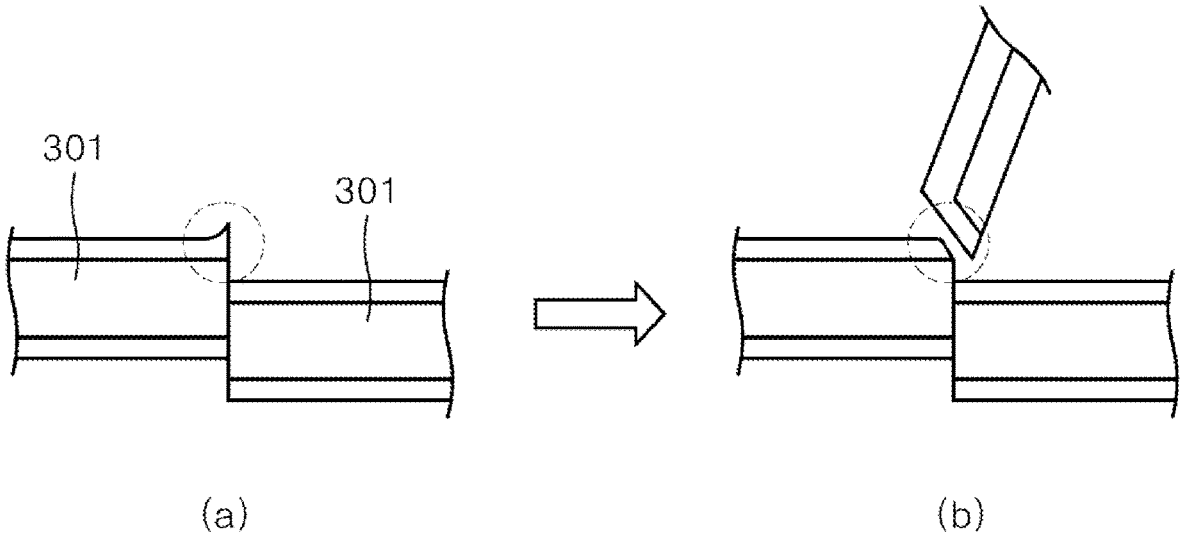
FIG. 12 is view showing processing work when a step difference is formed in a board of the present invention.
Figure 13:
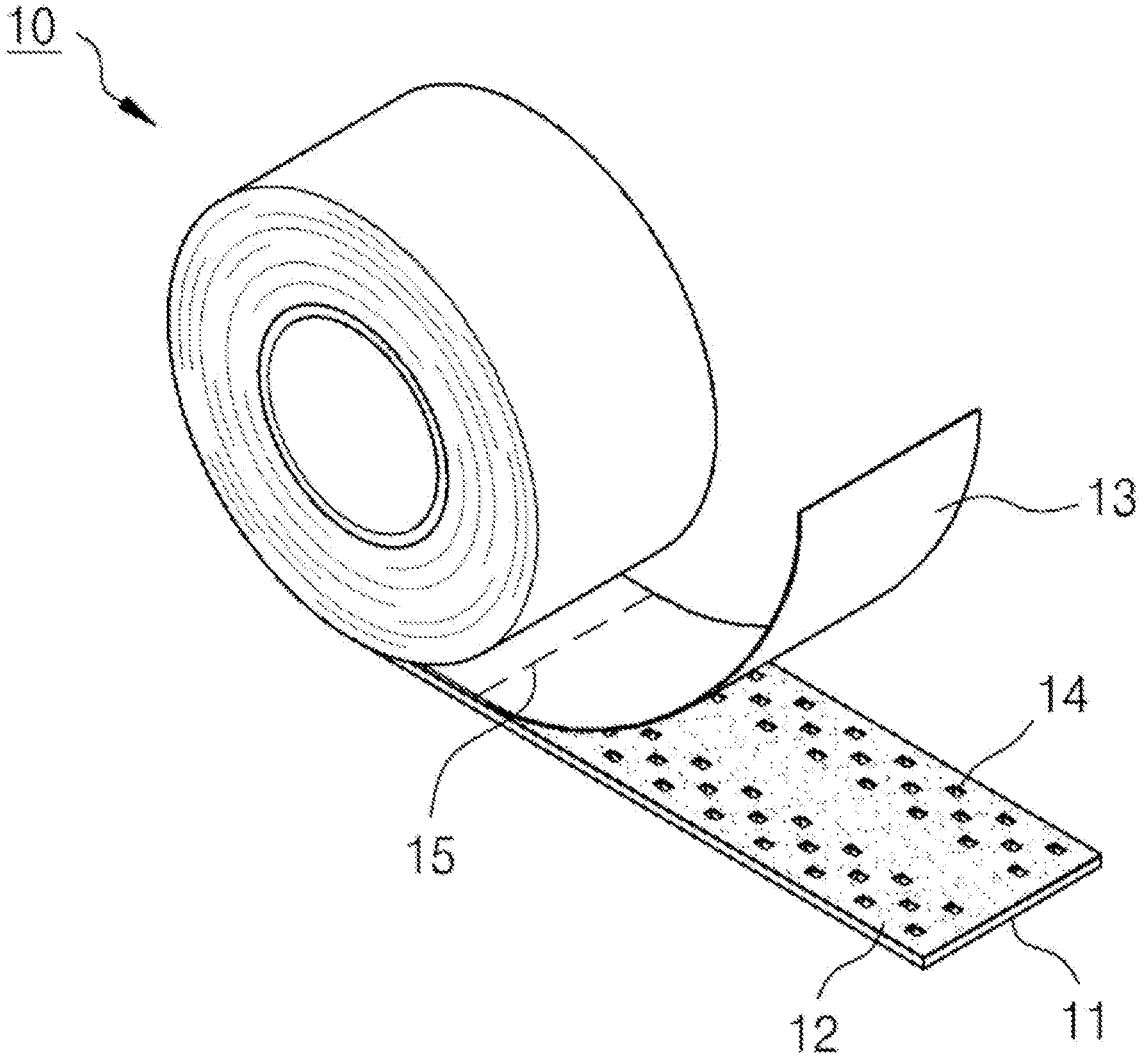
FIGS. 13 to 15 are views for explaining the related art.
Figure 14:
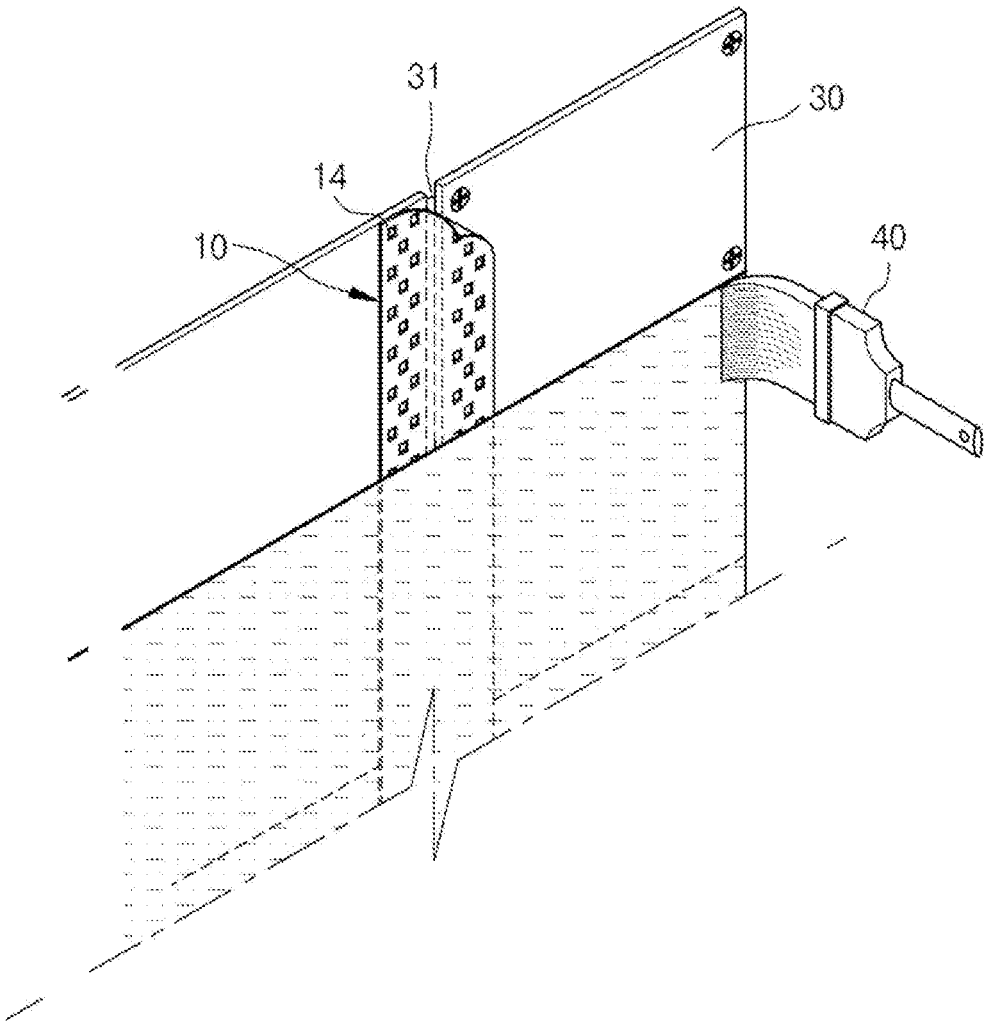
Figure 15:
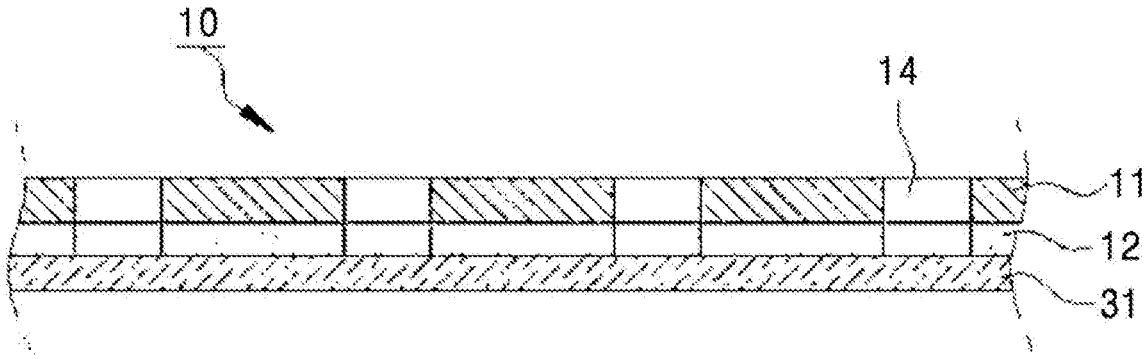

In addition, if the cut surface of the board is sharp as shown in FIG. 12 (*a*), it is preferable to smoothly process the cut surface of the board as shown in FIG. 12 (*b*) by using a back portion of a cutter knife or another hard tool before attaching the finishing tape.

Figure 8:
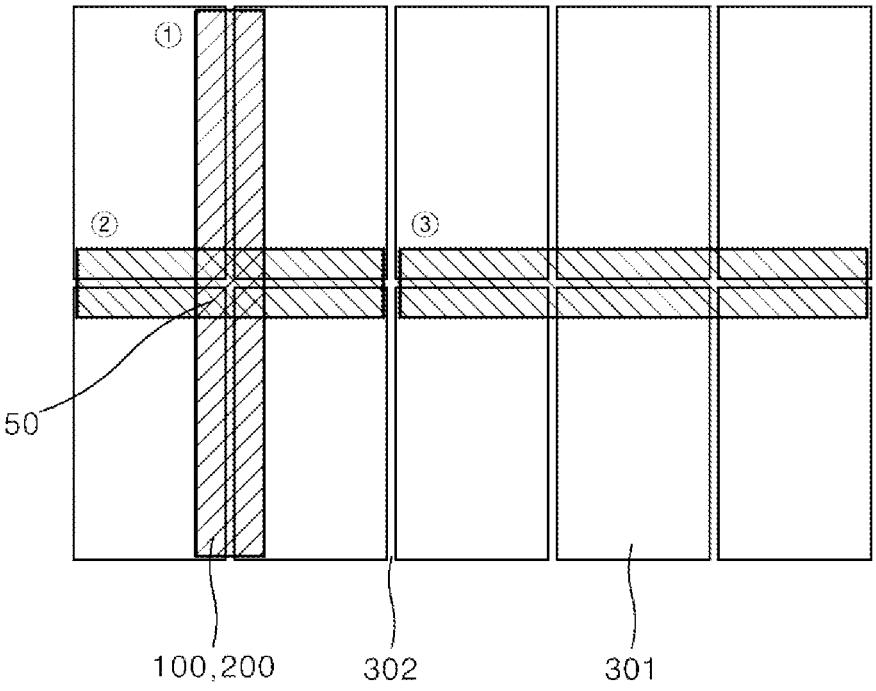

FIG. 8 shows the process of attaching the second and third finishing tapes 100 and 200 after attaching the first finishing tapes 100 and 200 in FIG. 7, in which the second finishing tape 100 and 200 is attached in the transverse direction on the first finishing tape 100 and 200.

However, when attaching the second finishing tape to cross over the first finishing tape, if the finishing tape is the finishing tape 200 for putty work, it is preferable to apply the intermediate agent (ark zoll) on the finishing tape 200 for putty work that is attached first, and then attach the finishing tape 200 for putty work at an intersection portion 50 where the two finishing tapes intersect.

Since the coating layer 30 is formed on the inside of the exterior paper 10 in the finishing tape 100 for painting work, there is no problem in adhesion force even if the finishing tape 100 for painting work is attached directly onto the exterior paper 10. However, in the case of the finishing tape 200 for putty work, since the coating layer 30 is formed on the outside of the exterior paper 10, the adhesive force is rather weak if the finishing tape 200 for putty work is attached directly onto the coating layer 30.

Referring to FIG. 8, the second finishing tape 100 and 200 is also cut after the work for the two boards has been completed, and then the third finishing tape 100 and 200 is provided for three boards.

In the vicinity of both ends of the second finishing tape 100 and 200, which are cut after cutting the second finishing tape 100 and 200, a woodworking bond is applied between the exterior paper 10 and the interior paper 20 or a stapler is used to combine the exterior paper and the interior paper to each other as described above.

Figure 9:
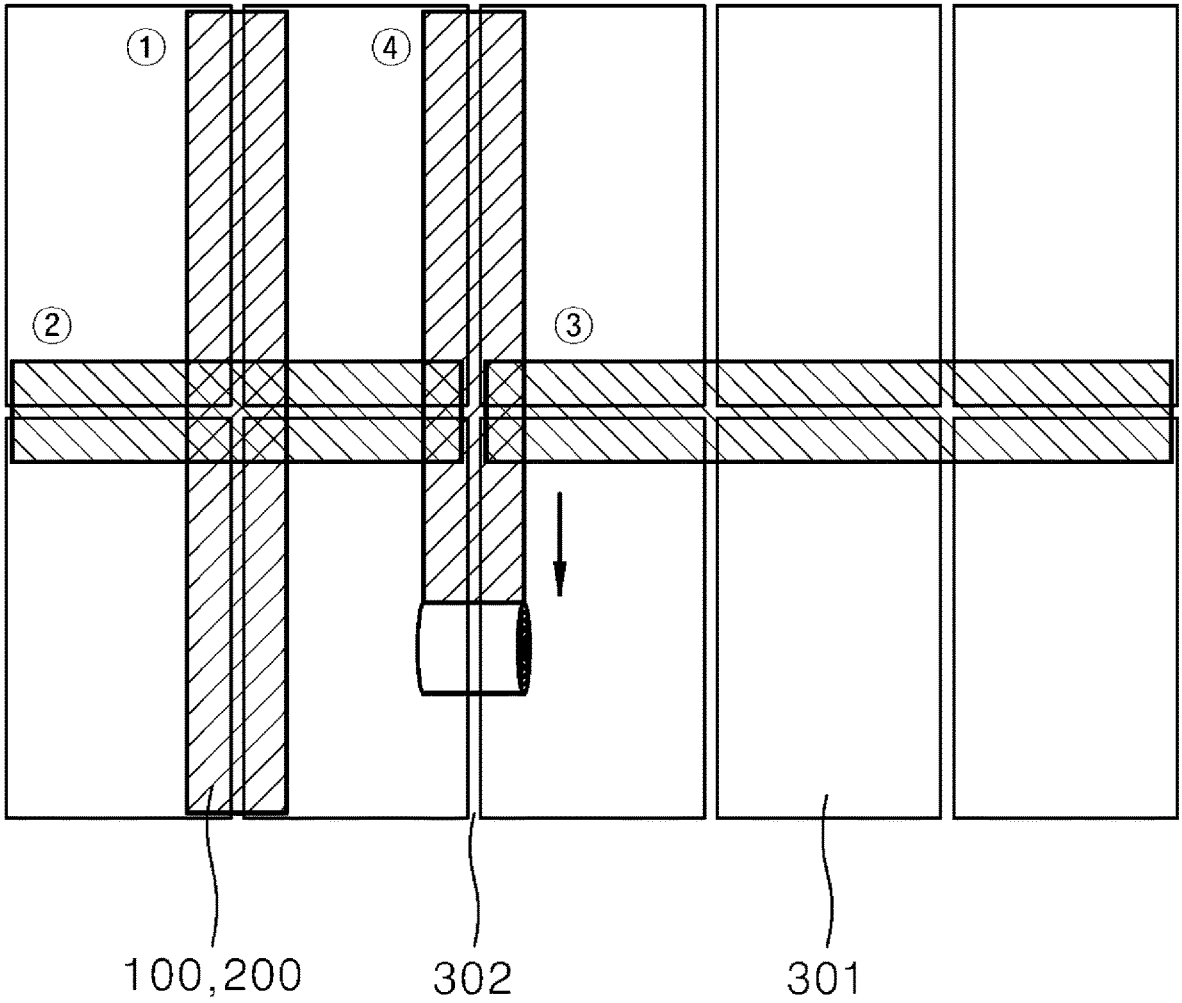

After the process of FIG. 8 has been completed, the process of attaching and cutting the fourth finishing tapes 100 and 200 is repeated as shown in FIG. 9.

After repeating the process of attaching, cutting, and combining the exterior paper and interior paper of the finishing tapes 100 and 200 described above, painting work or wallpaper work is performed.

When the finishing tape 100 for painting work is attached as the finishing tape, the painting work is proceeded immediately, or if necessary, the painting work is carried out after the putty work, and when the finishing tape 200 for putty work is attached as the finishing tape, the painting work is carried out after performing line putty work around a part to which the finishing tape 200 for putty work is attached, or after performing all putty work on the entire wall surface including a part to which the finishing tape 200 for putty work is attached.

Meanwhile, if there is a step difference between boards, the required strength may not be obtained by attaching the finishing tape only once in cases when attaching a finishing tape around a wall-mount type air conditioner, or when attaching a finishing tape to a joint of a heterogeneous material.

When attaching the finishing tape to a place where there is difficulty to attach the finishing tape compared to general joints or cracks, or if the strength higher than the finishing tape is required, the finishing tapes 100 and 200 may be overlapped twice at the same location and constructed in two layers.

However, in this case, the first-attached finishing tape 100 and 200 is attached such that the interior paper adhesive layer 40 and the exterior paper adhesive layer 41 are attached to the wall surface in the same manner as described above, and the second-attached finishing tape 100 and 200 placed on the first-attached finishing tape 100 and 200 is attached such that the interior paper adhesive layer 40 and the exterior paper adhesive layer 41 face the outside of the wall surface.

In this case, in order to attach the first-attached finishing tape 100 and 200 and the second-attached finishing tape 100 and 200, a wallpaper glue (in the case of a finishing tape for painting work) or intermediate agent (in the case of a finishing tape for putty work) is applied onto the first-attached finishing tape 100 and 200, and then the second-attached finishing tape 100 and 200 is attached onto the applied wallpaper glue or intermediate agent by turning over the second-attached finishing tape 100 and 200.

After attaching the interior paper adhesive layer 40 and the exterior paper adhesive layer 41 upside down to face the outside of the wall surface, the interior paper 20 is removed, and the painting work is performed after the remaining exterior paper adhesive layer 41 has been dried.

In the case that the work is duplicate twice, a finishing tape having no interior paper 20 may be used as the second-attached finishing tape to reduce the process of removing the interior paper. The finishing tape having no interior paper 20 may refer to a finishing tape where the interior paper 20 formed with the interior paper adhesive layer 40 is removed from the finishing tape 100 for painting work shown in FIG. 1 and the finishing tape 200 for putty work shown in FIG. 2. When using the finishing tape having no interior paper 20, the process described above proceeds as it is, but the process of removing the interior paper 20 is omitted.

Although the present invention has been described with reference to the embodiment shown in the drawings, the embodiments are illustrative purpose only, and those skilled in the art will understand that various modifications and equivalent may be possible therefrom.

Therefore, the technical protection scope of the present invention should be determined by the technical idea of the appended claims.

The invention claimed is:

1. A work method for finishing an inner wall surface of a building, the work method comprising:

a) attaching a finishing tape to at least one of a board joint, a wall surface joint, and a wall surface crack section;

b) cutting the finishing tape after attaching the finishing tape by a predetermined length;

c) repeating steps a) and b) for a space to be finished; and d) applying a paint or a wallpaper to an inner wall surface of a building including a surface onto which the finishing tape is attached, wherein the finishing tape is a finishing tape (100) for painting work, the finishing tape (100) for painting work includes an exterior paper (10) having a first surface and a second surface, an interior paper (20), and a coating layer (30) formed on one of the first and second surfaces of the exterior paper (10), exterior paper adhesive layers (41) are formed on one of the first and second surfaces of the exterior paper (10) at opposite sides of the coating layer (30) along a longitudinal direction of the exterior paper (10), the coating layer (30) is formed between the exterior paper adhesive layers (41), an interior paper adhesive layer (40) is formed over a first surface of the interior paper (20), and a second surface of the interior paper (20) is placed on the coating layer (30) so that the interior paper (20) and the coating layer (30) are provided in a non-adhesive state.

2. The work method of claim 1, wherein the exterior paper (10) has a multi-layer structure including an outer exterior paper (11) and an inner exterior paper (12), the outer exterior paper (11) has a width smaller than a width of the inner exterior paper (12), or the outer exterior paper (11) has a width greater than a width of the inner exterior paper (12).

3. The work method of claim 1, further comprising: applying a woodworking bond between the exterior paper (10) and the interior paper (20) of a cut section, or combining the exterior paper (10) and the interior paper (20) to each other by using a stapler, after step b).

4. The work method of claim 1, wherein, when performing step c), if the finishing tape is attached to a same location twice, the work method further includes: c-1) attaching a first finishing tape such that the interior paper adhesive layer (40) and the exterior paper adhesive layer (41) are attached to a wall surface; c-2) applying a wallpaper paste or an intermediate agent on the first finishing tape; c-3) attaching a second finishing tape on the applied wallpaper paste or intermediate agent in such a way that one side of the second finishing tape, other than the surface on which the interior paper adhesive layer (40) and the exterior paper adhesive layer (41) are formed, is attached to the wallpaper paste or the intermediate agent; and c-4) removing the interior paper (20) of the second finishing tape.

5. The work method of claim 1, wherein, when performing step c), if the finishing tape is attached to a same location twice, the work method further includes: c'-1) attaching a first finishing tape such that the interior paper adhesive layer (40) and the exterior paper adhesive layer (41) are attached to a wall surface; c'-2) applying a wallpaper paste or an intermediate agent on the first finishing tape; and c'-3) attaching a second finishing tape on the applied wallpaper paste or intermediate agent in which a finishing tape without an interior paper (20) is used as the second finishing tape, and one side of the second finishing tape, other than the surface on which the exterior paper adhesive layer (41) of the second finishing tape is formed, is attached to the wallpaper paste or the intermediate agent.

* * * * *